US010118138B2

(12) United States Patent
Tews

(10) Patent No.: US 10,118,138 B2
(45) Date of Patent: Nov. 6, 2018

(54) FLOATING MANURE AGITATOR WITH MULTIDIRECTIONAL AGITATOR NOZZLES

(71) Applicant: James Timothy Tews, Winona, MN (US)

(72) Inventor: James Timothy Tews, Winona, MN (US)

( * ) Notice: Subject to any disclaimer, the term of this patent is extended or adjusted under 35 U.S.C. 154(b) by 222 days.

(21) Appl. No.: 14/740,611

(22) Filed: Jun. 16, 2015

(65) Prior Publication Data

US 2015/0367297 A1 Dec. 24, 2015

Related U.S. Application Data

(60) Provisional application No. 62/014,958, filed on Jun. 20, 2014.

(51) Int. Cl.

| | |
|---|---|
| ***B01F 5/02*** | (2006.01) |
| ***B01F 5/10*** | (2006.01) |
| ***B01F 13/00*** | (2006.01) |
| ***B01F 15/00*** | (2006.01) |

(52) U.S. Cl.

CPC ..... *B01F 5/0225* (2013.01); *B01F 5/025* (2013.01); *B01F 5/0218* (2013.01); *B01F 5/0243* (2013.01); *B01F 5/10* (2013.01); *B01F 13/0049* (2013.01); *B01F 15/00305* (2013.01); *B01F 2215/0001* (2013.01)

(58) Field of Classification Search

CPC ..... B01F 5/0225; B01F 5/0243; B01F 5/10; B01F 13/0049; B01F 15/00305; B01F 5/0218; B01F 5/025; B01F 2215/0001

See application file for complete search history.

(56) References Cited

U.S. PATENT DOCUMENTS

| | | | | |
|---|---|---|---|---|
| 2,599,993 A * | 6/1952 | Hill | A01B 63/22 | 280/405.1 |
| 2,983,508 A * | 5/1961 | Modine | B63B 17/00 | 261/120 |
| 3,139,060 A * | 6/1964 | Dane | A01M 7/0082 | 239/725 |
| 3,142,281 A * | 7/1964 | Muller | E02B 15/046 | 210/242.3 |
| 3,421,472 A * | 1/1969 | Oberg | B60F 3/0007 | 114/344 |
| 3,599,722 A * | 8/1971 | Davidson | A62C 27/00 | 169/24 |

(Continued)

*Primary Examiner* — Tony G Soohoo

(74) *Attorney, Agent, or Firm* — Schroeder & Siegfried, P.A.

(57) ABSTRACT

An aquatic floating manure agitator vessel including a plurality of remotely controlled above-surface agitator nozzles which are visibly positioned on the vessel and hydraulically movable about multiple axes to facilitate effective pond agitation and directional control of the floating agitator. The floating agitator includes a vertically adjustable hydraulic undercarriage and hitch mechanism to facilitate ease of maneuverability during launching and removal of the floating agitator, and for probing the pond bottom for excess sludge build-up. The floating agitator also includes hydraulically folding side wings or pontoons mounted on each side of the vessel to further enhance ease of maneuverability and storage of the vessel.

19 Claims, 7 Drawing Sheets

(56) References Cited

U.S. PATENT DOCUMENTS 3,755,835 A * 9/1973 Boersig ..... B63C 13/00 114/344
3,800,950 A * 4/1974 Hess ..... E02B 15/041 210/242.4
3,840,457 A * 10/1974 Wilson ..... A01C 3/00 210/197
3,852,378 A * 12/1974 Guida ..... B01F 3/0473 210/242.2
3,862,904 A * 1/1975 Weatherford ..... E02B 15/046 210/242.3
3,885,331 A * 5/1975 Mathieu ..... E02F 5/287 114/151
3,942,457 A * 3/1976 Keyes ..... A01C 7/004 111/200
4,176,726 A 12/1979 Schaeff
4,191,479 A * 3/1980 Shuck ..... B01F 3/04765 114/264
4,268,398 A * 5/1981 Shuck ..... B01F 3/04765 111/101
4,482,510 A * 11/1984 Khudenko ..... B01F 3/04773 210/242.2
4,485,013 A * 11/1984 Cockman ..... B01D 33/04 210/242.2
4,519,714 A 5/1985 Johnson et al.
4,551,244 A * 11/1985 Inoue ..... E02B 15/046 210/198.1
4,587,064 A * 5/1986 Blum ..... B63B 35/00 210/242.2
4,594,006 A 6/1986 Depeault
4,747,958 A * 5/1988 Eberhardt ..... C02F 1/66 210/198.1
4,798,020 A * 1/1989 George ..... A01K 80/00 209/935
4,806,251 A * 2/1989 Durda ..... B01F 3/04539 210/170.05
4,817,978 A * 4/1989 James ..... B60D 1/586 267/138
4,818,416 A * 4/1989 Eberhardt ..... C02F 1/66 210/198.1
4,877,524 A * 10/1989 Eberhardt ..... C02F 1/66 144/264
5,040,918 A * 8/1991 Taricco ..... E02B 15/08 156/78
5,064,392 A * 11/1991 Wonders ..... A62C 29/00 169/62
5,089,120 A * 2/1992 Eberhardt ..... C02F 1/66 114/124
5,185,085 A * 2/1993 Borgren ..... B63B 35/32 210/170.05
5,256,263 A * 10/1993 Kanai ..... C02F 1/463 204/242
5,257,797 A * 11/1993 Johnson ..... B60D 1/465 172/248
5,262,048 A * 11/1993 Zimmerman ..... C02F 1/681 210/232
5,264,127 A * 11/1993 Ngo ..... C02F 3/06 210/151
5,301,756 A * 4/1994 Relyea ..... A62C 27/00 169/24
5,377,913 A * 1/1995 Van Der Woude ..... B05B 13/0431 165/95
5,702,614 A * 12/1997 Taylor ..... B01F 9/0007 210/170.05
5,788,158 A * 8/1998 Relyea ..... B05B 13/005 169/24
5,868,091 A * 2/1999 Gross ..... B63B 1/121 114/61.1
5,988,601 A * 11/1999 Burgess ..... A01K 63/042 119/263
6,159,058 A * 12/2000 Matheson ..... B63C 13/00 114/344
6,209,148 B1 * 4/2001 Hoffman ..... A47C 15/006 4/487
6,269,763 B1 * 8/2001 Woodland ..... A62C 29/00 114/144 A
6,857,583 B2 * 2/2005 Attar ..... B08B 3/026 239/124
D502,983 S * 3/2005 Mitjans ..... D23/201
7,150,239 B2 * 12/2006 Blumenthal ..... E02B 1/003 114/40
7,188,440 B2 * 3/2007 Hofland ..... E02F 3/885 37/313
7,314,395 B2 * 1/2008 Bryham ..... B60F 3/0007 114/344
7,448,600 B1 * 11/2008 Boulter ..... C02F 1/048 159/4.4
7,611,075 B2 * 11/2009 Relyea ..... A62C 27/00 169/24
8,256,748 B1 * 9/2012 Boulter ..... C02F 1/048 159/4.4
8,579,264 B1 * 11/2013 Fowles ..... C02F 1/008 261/26
9,462,741 B2 * 10/2016 Puck ..... A01C 3/026
9,694,636 B2 7/2017 Nuhn
2003/0019949 A1 * 1/2003 Solie ..... A01C 23/047 239/172
2003/0030157 A1 * 2/2003 Petrescu ..... B01F 3/04765 261/92
2006/0032797 A1 * 2/2006 Tsai ..... E04H 4/169 210/150
2006/0279006 A1 * 12/2006 Tsai ..... B01F 3/0473 261/4
2008/0047481 A1 * 2/2008 Maarschalkerweerd ..... B60F 3/0069 114/344
2009/0014186 A1 * 1/2009 Collins ..... A62C 27/00 169/24
2012/0319310 A1 * 12/2012 Sun ..... B01F 7/00733 261/30
2013/0145980 A1 * 6/2013 Puck ..... B63B 7/00 114/354
2013/0207282 A1 * 8/2013 Tsai ..... B01F 3/04106 261/5
2014/0076820 A1 * 3/2014 Caldwell ..... C02F 7/00 210/696
2014/0112093 A1 * 4/2014 Puck ..... A01C 3/026 366/182.2
2015/0216118 A1 * 8/2015 Swinney, II ..... A01M 7/0042 239/159
2015/0367297 A1 * 12/2015 Tews ..... B01F 5/0225 366/182.2
2017/0232809 A1 8/2017 Nuhn
2018/0036692 A1 * 2/2018 Bearinger ..... B01F 5/0225

* cited by examiner

FLOATING MANURE AGITATOR WITH MULTIDIRECTIONAL AGITATOR NOZZLES

TECHNICAL FIELD

The present invention relates generally to the field of floating vessels and, more particularly, to a remote-controlled floating aquatic manure agitator for use in a manure earthen storage installation, such as a manure holding pond, lagoon, settling basin or other manure reservoir.

BACKGROUND OF THE INVENTION

The benefits of manure as a fertilizer for agricultural purposes are well known. Manure from livestock is an excellent source of fertilizer containing nitrogen, phosphorous and other nutrients desirable for enrichment of soil. Manure is also an important source of organic matter which, when added to soil, helps to improve soil composition, aeration, water infiltration and moisture-retention capability.

As a necessary and inevitable by-product of the livestock industry, manure is in constant supply and a means of storage and preservation is therefore required. For this reason, earthen storage installations in the nature of holding ponds, lagoons and settling basins have been developed and successfully utilized for the storage of large quantities of manure. Since manure is a biologically active substance, during storage, it tends to break down and settle out into fractions of liquids and solids that float, sink or remain suspended in the liquid. Over time, some of these solids tend to form a thick floating crust and other solids tend to settle to the bottom in the form of sludge. If the sludge layer is not periodically agitated and removed, it will eventually decrease the available volume of the storage installation area, thus leading to increased risk of overflows, economic and environmental concerns, etc.

Conventionally, the most common and economical way in which to maintain the manure stored in such an earthen storage installation is through the use of agitation and pumping equipment. Remote-controlled floating vessels with power take-off (PTO), low pressure, high-volume pressure pumps are typically used as agitators for manure ponds and lagoons. These pumps generally include one or more high pressure nozzles that extend into the manure pond and agitate the liquid/solid mixture by using the force of moving water to dislodge and mix the bottom sludge with other floating matter. This creates a slurry mixture that is capable of being pumped from the manure pond into tank wagons for transport and dispersion in the agricultural fields.

While conventional floating agitators work reasonably well for their intended purpose, there are drawbacks. For instance, most floating agitators use the high pressure nozzles or jets not only for purposes of agitation, but also for directional control of the vessel. However, with many floating agitators, one or more of the agitator nozzles often point directly downward from underneath the vessel, out of sight of the operator. Other agitators include above-surface nozzles, but such nozzles are limited in movement only in the vertical direction. This limited visibility and versatility makes directional control of the vessel extremely difficult, particularly when being operated remotely.

Maneuvering a floating agitator in and out of a manure pond or lagoon can also pose a significant challenge. One drawback of conventional floating agitators is that they typically must be pulled out of the lagoon and loaded onto a separate trailer for hauling by a transport vehicle, such as a tractor. Some agitators do include wheels, but such wheels are generally not adjustable relative to the floating vessel. Consequently, the floating vessel can bottom out and become hung up on the ramp, thus loosing valuable time and potentially causing significant damage to the hull of the vessel; this is particularly the case with steep ramps leading into the lagoon.

Another drawback is that, upon launching, removing or simply transporting a conventional floating vessel to or from a manure pond, the operator(s) must manually make the connection of the vessel to a transport vehicle or trailer. Here again, the operator must continually get in and out of the transport vehicle to connect/disconnect the vessel, or have others available to help. This either requires increased manpower or, at a minimum, adds time and inconvenience to the overall operation.

Still further, conventional floating vessels used in manure ponds and the like are often agitated during cold weather conditions, where ice build-up may occur on the pond. Other than through movement of the slurry caused by the jet pumps, there is typically no means by which the vessel can break up large chunks of ice. Thus, the floating vessel can become inhibited from free movement around the pond, making it impossible to adequately agitate the full area of the pond.

Still another drawback of conventional floating agitators is that there is typically no means by which an operator, particularly remotely, can test to determine whether the jet pumps are adequately stirring up and mixing the bottom sludge with the liquid portion of the pond. Particularly with floating vessels having submerged output nozzles, it is difficult to determine where the nozzles are actually being aimed and whether additional sludge may have accumulated on the bottom of a certain area of the pond. It is therefore difficult to determine whether agitation of the pond has been successfully completed, or where additional agitation would be beneficial.

Therefore, it is evident there is a substantial and unsatisfied need in the agricultural industry for a reliable and cost-effective solution to the many drawbacks associated with conventional floating manure agitators. Accordingly, for optimum agitation and directional control, it would be desirable to provide a floating agitator with high pressure jet nozzles that are fully visible and capable of movement in multiple directions. It would be further desirable for the floating vessel to include an adjustable wheel carriage for ease in launching and removing the vessel from a pond, and an automated means for connecting the same to a transport vehicle. It would also provide added benefit to include a cost-effective and efficient means on the floating vessel for breaking ice remotely and for determining potential remaining areas of sludge build-up in the manure pond which require break-up.

It is with the above difficulties of the prior art in mind that has caused me to develop the present invention, which substantially eliminates the aforementioned drawbacks of conventional floating manure agitators and provides new and additional benefits, as will be described in more detail hereafter.

BRIEF SUMMARY OF THE INVENTION

To overcome the problems known in the prior art and achieve the desired goals set forth herein, one aspect of the present invention includes a floating aquatic manure agitator vessel having a plurality of above-surface remotely controllable agitator nozzles strategically positioned and visible on the floating vessel to facilitate effective pond agitation and directional control of the floating vessel. In a preferred embodiment, two nozzles are positioned on the stern or aft-most portion of the vessel, with one additional nozzle positioned toward the bow. For maximum versatility and reach, each pressure nozzle is constructed for multi-axis rotational movement, capable of substantially 180 degree rotation about a generally vertical axis and vertical pivotal movement of more than 90 degrees about a horizontal axis.

The vessel is equipped with a low pressure, high-volume PTO pressure pump which draws effluent from the pond to feed the high pressure agitator nozzles. By way of example, in a preferred embodiment, the use of an 8" Houle vertical super pump manufactured by GEA Farm Technologies (with a 26% reducing gearbox) is contemplated for use in feeding the agitator pressure nozzles. While any suitable motor is contemplated for powering the effluent pump for its desired purpose, in a preferred embodiment, the pump is preferably powered by a 240 HP CNH drive motor, or equivalent, with a 2:1 gear reducing gearbox. It is also contemplated that the PTO drive shaft for the pump be configured with shear pins to prevent damage to the pump in the event of a jam.

According to another aspect of the present invention, the floating agitator includes a hydraulically powered undercarriage which is vertically adjustable to facilitate ease of maneuvering the vessel in and out of the manure pit. When launching or removing the vessel from a manure pond or lagoon, the undercarriage may be vertically adjusted via remote control to effectively raise the floating vessel off the ground, thereby avoiding any potential damage to the vessel from steep ramps or rough terrain. As the undercarriage lowers, the undercarriage wheels engage the ground surface, thus lifting the vessel well off the ground for clearance and safe transport.

To further facilitate maneuverability and transportation of the floating agitator, another aspect of the present invention includes a remotely controllable hydraulic hitch which is vertically pivotal to allow an operator to connect and disconnect the floating vessel from a transport vehicle without the need for manual manipulation. The operator may simply align the transport vehicle adjacent the vessel hitch and lower the hitch via remote control to connect the vessel to the transport vehicle. Similarly, upon launching the vessel, the hitch may be easily disconnected remotely by simply raising the adjustable hitch to disengage the hitch from the transport vehicle. No need for manual manipulation of the hitch is required; therefore, the operator spends less time climbing in and out of the transport vehicle, with less opportunity for operator injury.

Still another aspect of the present invention includes folding wings or pontoons mounted on opposite sides of the floating agitator vessel. These wings are also hydraulically operated, and can be raised and lowered via remote control. Consequently, for storage and travel, the wings can be hydraulically lifted to an upright position, thereby significantly reducing the width of the vessel for ease in road travel and passage through tight areas, such as gates, etc. For launching the vessel, the wings are simply lowered for floatation.

As noted previously, in a preferred embodiment, all hydraulic applications, including operation of the multi-axis pressure nozzles, and the hydraulic undercarriage, hitch and side wings, are remotely controllable through the use of a user-friendly handheld control unit. For ease of operating the multi-axis rotating pressure nozzles, the control unit incorporates separate joystick controls for each, such that the operator can easily maneuver each of the nozzles at will with full view of the positioning of the nozzles at all time. Consequently, there is no guesswork involved as to where the nozzles are pointed for agitation and directional control purposes.

BRIEF DESCRIPTION OF THE DRAWINGS

These and other objects and advantages of the invention will more fully appear from the following description, made in connection with the accompanying drawing, wherein.

DETAILED DESCRIPTION OF THE INVENTION

Figure 1:
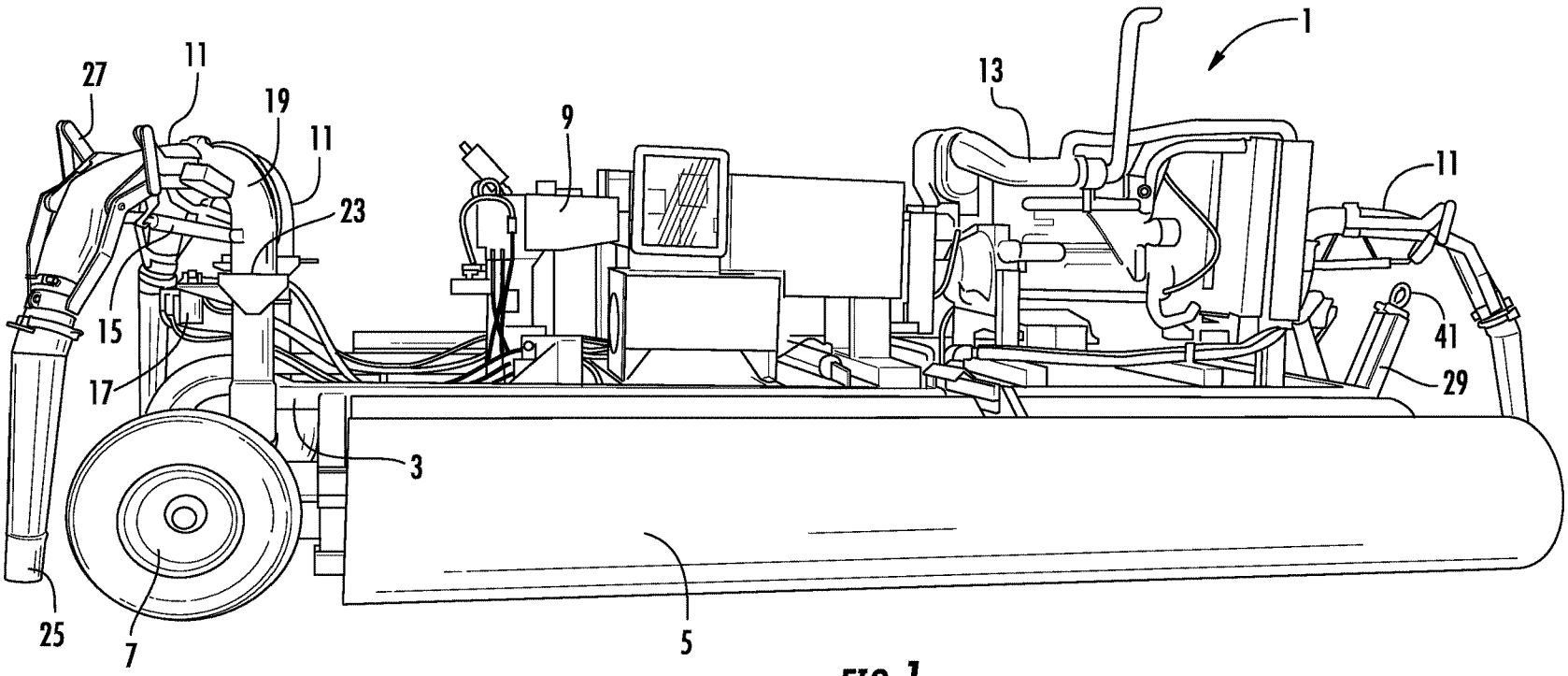
FIG. 1 is a side elevation view of a floating manure agitator vessel constructed in accordance with the present invention.

With reference to FIG. 1, a floating aquatic manure agitator vessel 1 is shown constructed in accordance with the present invention. As shown, the main body or deck 3 of the vessel is flanked on each side by a large wing 5 which functions to maintain the vessel 1 afloat in the manure pond upon launching same. Each wing 5 of the vessel extends substantially the entire length of the vessel 1 and is preferably comprised of a pair of integrally connected laterally juxtaposed pontoons. As will be described in more detail hereafter, each wing 5 is pivotally adjustable upwardly and downwardly to facilitate ease of transporting the manure agitator vessel 1. The deck 3 further includes an undercarriage system 7 with wheels to facilitate launching and removal of the vessel from the manure pond, as well as transportability and storage of the vessel.

Mounted atop of the deck 3 of the vessel 1 is a low pressure, high-volume PTO pressure pump 9 which draws effluent from the pond to feed a plurality of above-surface high pressure agitator nozzles 11. As shown generally in FIG. 1 and described hereafter, all agitator nozzles 11 are mounted atop the vessel deck 3 and constructed and arranged for multi-axis pivotal movement. This facilitates maximum versatility and reach for agitating the pond slurry, and for maintaining directional control of the vessel 1. In a preferred embodiment, the use of an 8" Houle vertical super pump manufactured by GEA Farm Technologies (with a 26% reducing gearbox) is contemplated for use in feeding the agitator pressure nozzles 11. While any suitable motor 13 is contemplated for powering the effluent pump 9 for its desired purpose, in a preferred embodiment, the pump 9 is preferably powered by a 240 HP CNH drive motor, or equivalent, with a 2:1 gear reducing gearbox. Although not shown in the drawings, the PTO drive shaft extending from the 2:1 reducing gearbox to the pump 9 is preferably configured with shear pins to prevent damage to the pump 9 in the event of a jam.

As noted above and shown throughout the drawings, each of the agitator nozzles 11 that are fed by pump 9 is an above-surface nozzle, i.e., mounted atop the vessel deck 3 so as to be readily visible by the vessel operator at all times. Each nozzle 11 is comprised essentially of a tubular pipe member 19 connected to pump 9 via a piping system 21. The pipe member 19 of each nozzle 11 is rotationally connected to the piping system 21 at joint 23, where it is permitted to rotate substantially 180 degrees about a generally vertical axis. From Joint 23, pipe member 19 extends upwardly and then elbows 90 degrees outward toward a nozzle terminal end portion 25. Linkage 27 provides flexibility between pipe member 19 and the terminal end portion 25 of each nozzle 11, allowing the terminal end portion 25 to move upward and downward relative to a horizontal axis through a range of motion exceeding 90 degrees.

Figure 2:
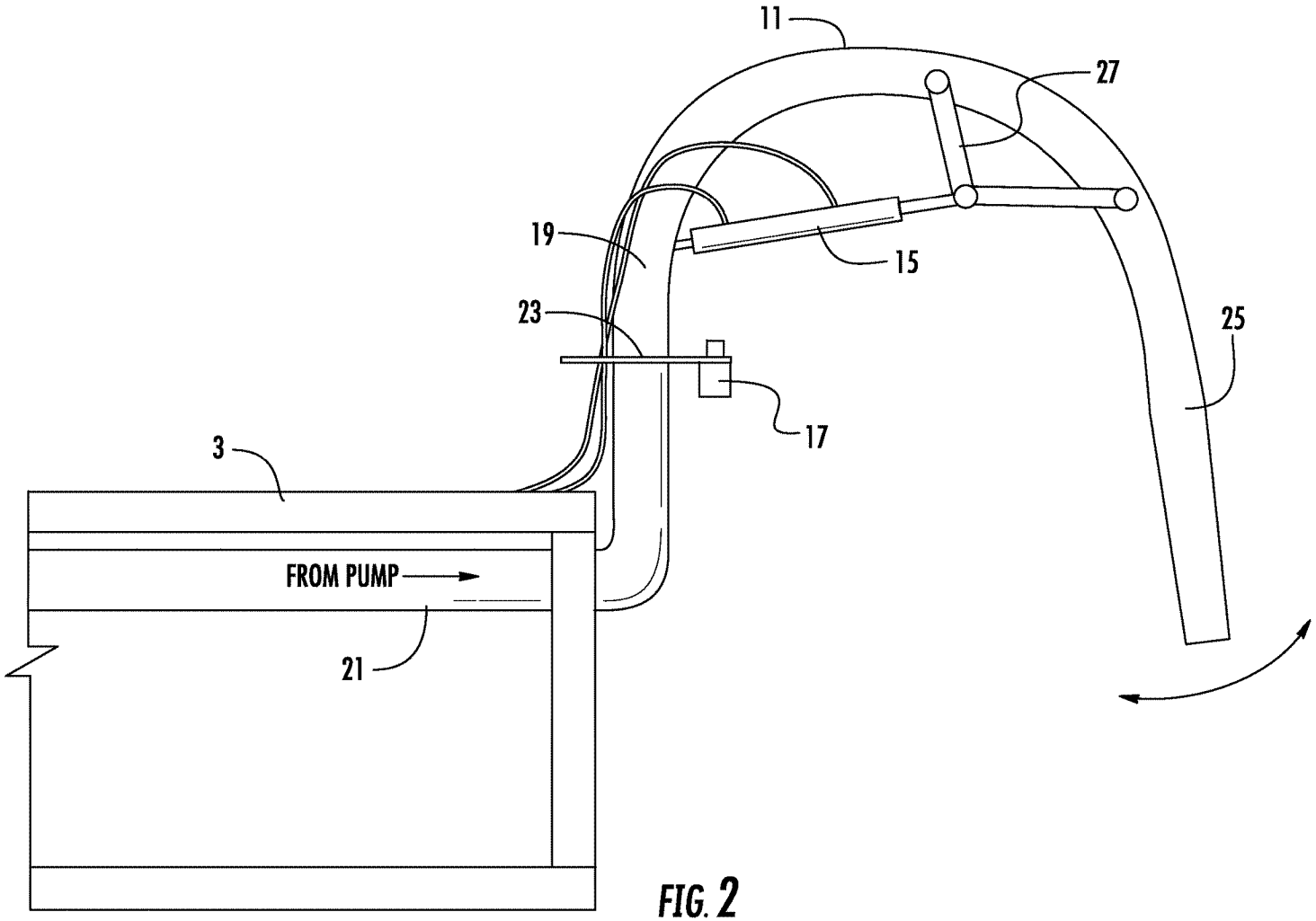
FIG. 2 is a side elevation view of one of the multi-axis above-surface agitator nozzles utilized for pond agitation and directional control of the floating agitator vessel.
Figure 3:
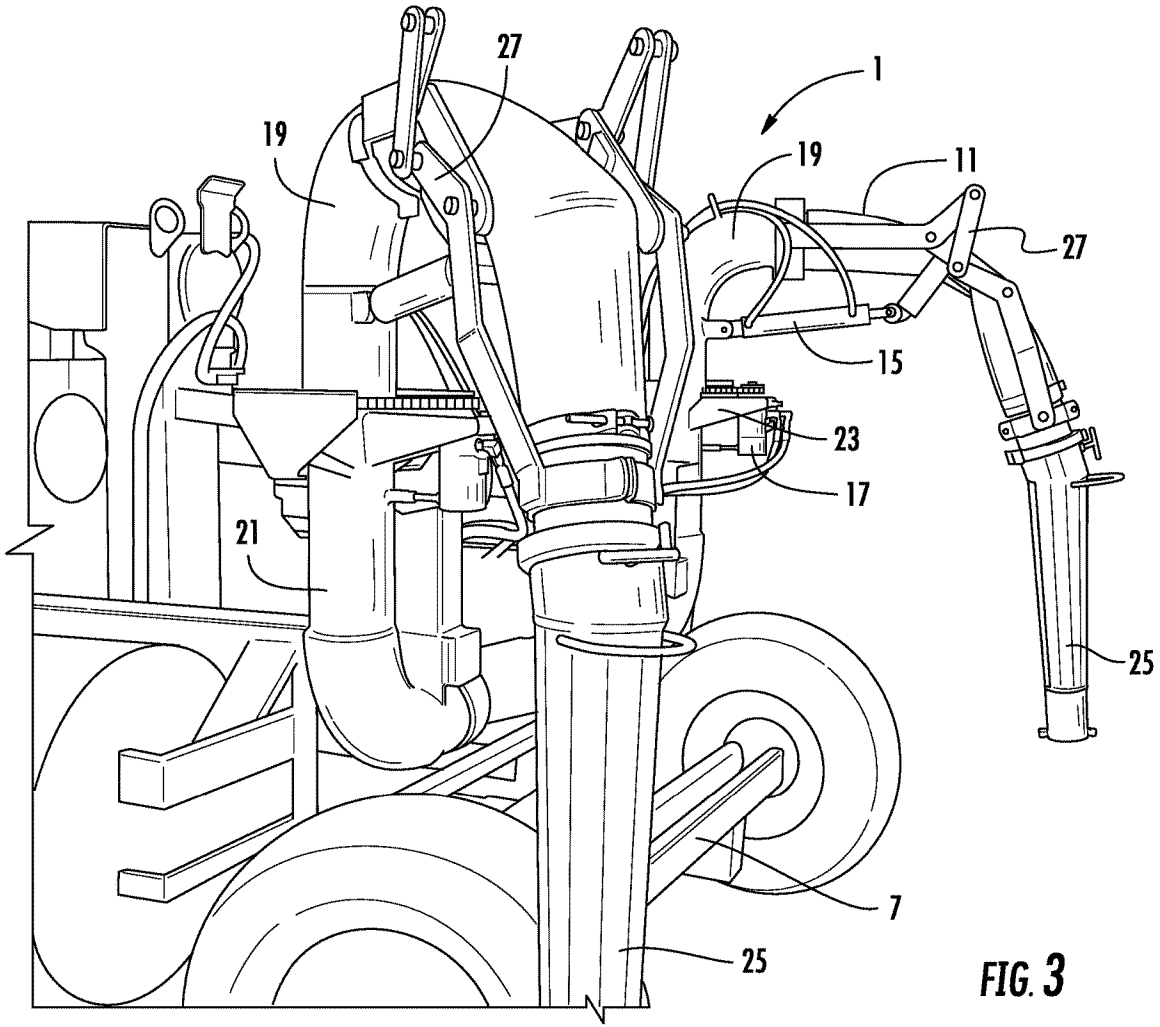
FIG. 3 is a close-up perspective view of the rear agitator nozzles mounted on the stern portion of the floating agitator vessel.
Figure 4:
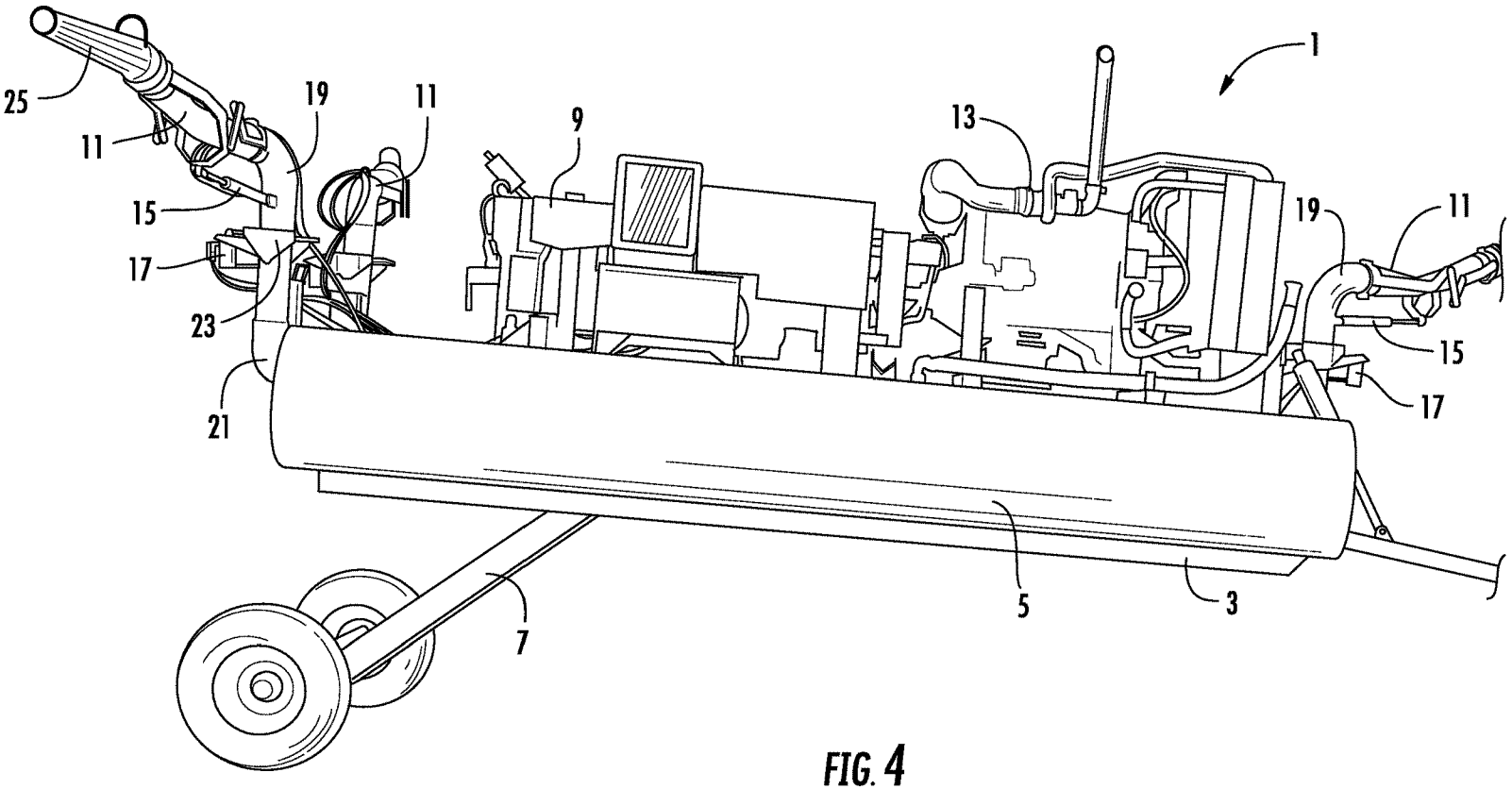
FIG. 4 is a side elevation view showing the hydraulically adjustable undercarriage which raises the stern of the floating vessel to facilitate launching and removal of the vessel from a manure pond.

As shown best in FIGS. 2 and 3, for optimum mobility, each nozzle 11 is equipped with separate hydraulic actuator mechanisms 15 and 17 to cause movement about multiple axes. Hydraulic actuator 15 is connected between pipe member 19 and linkage 27 of the nozzle 11, and extends and retracts to cause pivotal movement of the terminal end portion 25 of nozzle 11 generally in the vertical direction. Hydraulic actuator 17, on the other hand, is connected adjacent the rotatable joint 23 of pipe member 19, and is configured to cause rotational movement of each nozzle 11 substantially 180 degrees about a generally vertical axis. By way of example, in FIG. 3, the agitator nozzles 11 are shown with hydraulic actuators 15 retracted, so the terminal end portions 25 thereof will point downward into the manure pond. In FIG. 4, however, the nozzles 11 are depicted with the hydraulic actuators 15 fully extended, such that the terminal end portions 25 thereof point generally upward and outward to an elevated position above horizontal. In FIG. 4, the rotational actuator 17 on each stern nozzle 11 is also shown in a position rotating the stern nozzles 11 outwardly away from and beyond the outer confines of the vessel 1 to cause the pond effluent to be pump toward the sides of the vessel.

As best shown in FIGS. 1 and 4, multiple above-surface nozzles 11 are strategically positioned and highly visible on the top surface of deck 3 of the floating vessel 1 to facilitate effective pond agitation and directional control of the vessel. In a preferred embodiment, two nozzles 11 are positioned on the stern or aft-most portion of the vessel 1, with one additional nozzle 11 positioned toward the bow. The stern nozzles 11 are preferably positioned one each adjacent each rear corner of the vessel 1, with the nozzle at the bow being centrally located between the opposing front corners thereof. As noted above, for maximum versatility and reach, each pressure nozzle is constructed for multi-axis pivotal movement, capable of substantially 180 degree rotation about a vertical axis and vertically pivotal more than 90 degrees about a horizontal axis. Consequently, with the enhanced mobility of nozzles 11, a vessel operator may effectively agitate the manure pond and simultaneously maintain accurate and easy directional control of the vessel 1 solely through the thrust of the readily visible above-surface high pressure jet nozzles 11. This is particularly beneficial when operating the floating manure agitator 1 remotely, which will be described in more detail hereafter.

As shown best in FIG. 4, the floating agitator vessel 1 includes a hydraulically powered undercarriage system 7 which is vertically adjustable to facilitate ease of maneuvering the vessel 1 in and out of a manure pit. As shown, the wheels of the undercarriage system 7 are position near the stern of the vessel 1, with the supporting undercarriage frame being cantilevered to the vessel deck 3 more toward the center of the vessel 1. During operation of the agitator 1 in a manure pond, the undercarriage is usually retracted, as shown in FIG. 1. However, when launching or removing the vessel from a manure pond or lagoon, it is beneficial to lower the undercarriage 7 to raise the stern of the vessel 1, thus avoiding potential damage to the vessel 1 resulting from loading ramps having steep grades or rough terrain. Upon actuation of the system hydraulics, the frame of the undercarriage 7 will pivot downwardly from the vessel deck 3, thereby causing the undercarriage wheels to engage the ground and raise the stern of the vessel 1 upwardly, as shown in FIG. 4. Consequently, the aft end of the vessel 1 will be elevated well off the ground for clearance and safe transport of the vessel.

During operation of the manure agitator in a manure pond, it is also possible for the operator to use the undercarriage system 7 as a tool to help determine whether there is accumulated sludge at the bottom of the manure pit that requires agitation and mixture with the remaining pond liquids. By lowering the undercarriage 7 within the manure pond, the wheels extend downward, thus probing the bottom of the pit to determine the existence of undue sludge accumulation in the immediate area of the floating vessel 1. If significant accumulation exists, the aft end of the vessel 1 will rise due to the undercarriage 7 engaging the floor of the manure pit, thereby signaling the operator of the need to agitate that area of the pit more aggressively.

Figure 5:
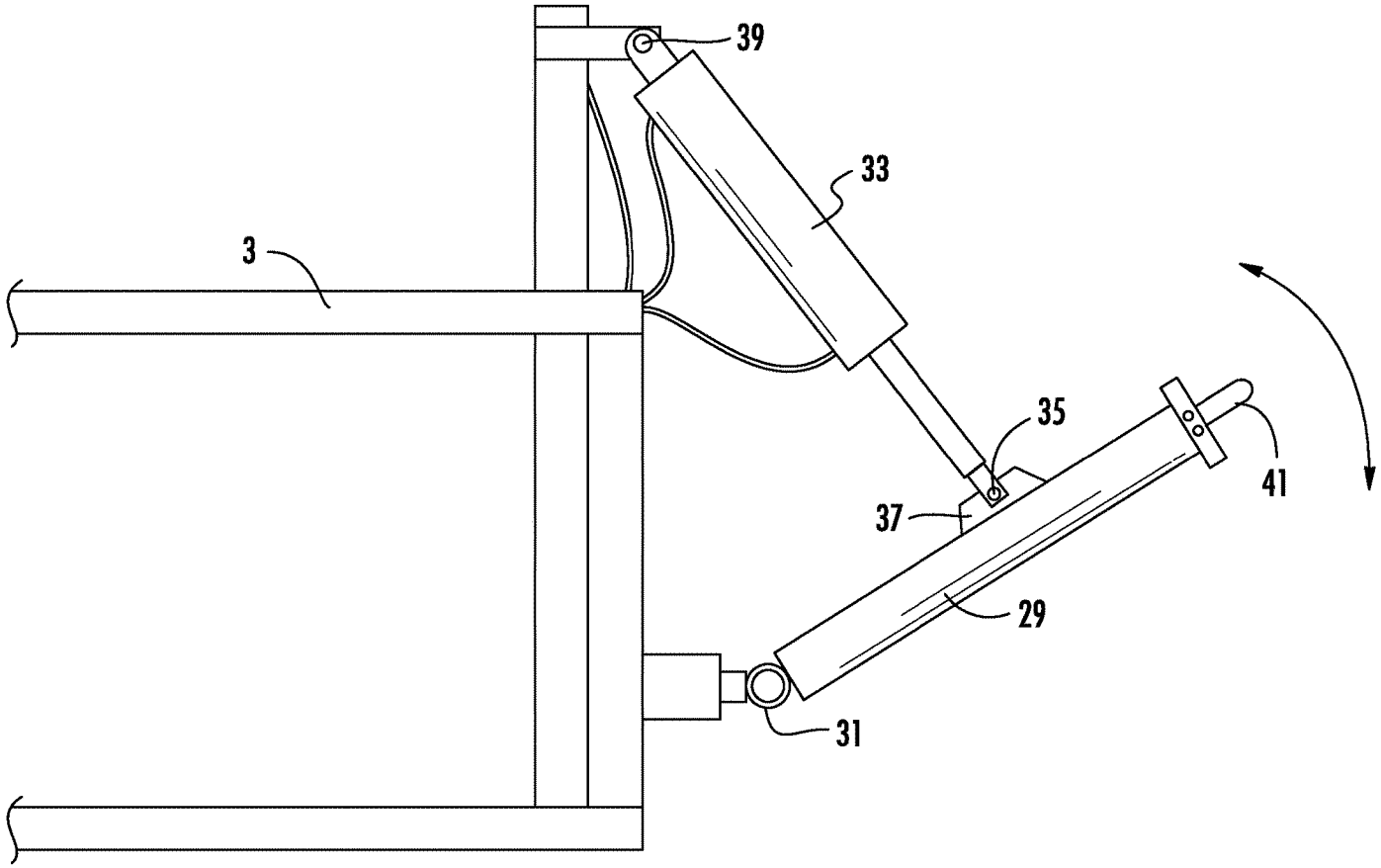
FIG. 5 is a close-up side elevation view showing the operation of the hydraulic hitch of the floating manure vessel, which facilitates ease of connecting the floating vessel to a transport vehicle.

As shown best in FIG. 5, to further facilitate maneuverability and transportation of the floating agitator, a remote-controlled hydraulically pivotal hitch 29 is also provided to allow an operator to connect and disconnect the floating vessel 1 from a transport vehicle (not shown) without the need for manual manipulation. Significant time is lost when an operator must continually climb in and out of a transport vehicle to hitch and unhitch the floating vessel 1. As part of the present invention, the hitch 29 is pivotally connected via a pivotal coupling 31 to the deck 3 of the floating vessel 1. One end 35 of a hydraulic operating cylinder 33 is pivotally connected to a bracket 37 mounted adjacent the center of hitch 29, with the opposite end 39 being pivotally connected to an upper portion of the vessel deck 3.

Consequently, upon actuation of hydraulic cylinder 33, the hitch 29 is configured to pivot up and down about a horizontal axis extending through the pivotal coupling 31. In this manner, the terminal end 41 of the hitch 29 may be moved up and down for coupling with the corresponding connector (e.g., ball hitch) of the transport vehicle. The operator may simply align the transport vehicle adjacent the vessel hitch 29 and lower the hitch via remote control to connect the vessel 1 to the transport vehicle. Similarly, upon launching the vessel 1, the hitch 29 may be easily disconnected remotely by simply actuating hydraulic cylinder 33, thereby raising the adjustable hitch to disengage the hitch 29 from the transport vehicle. No need for manual manipulation of the hitch 29 is required; therefore, the operator spends less time climbing in and out of the transport vehicle, with less opportunity for operator injury.

Such a hydraulically operable hitch 29 also has the benefit that it can be used an ice-breaking mechanism during winter. Oftentimes during cold periods of winter, manure ponds can become at least partially covered with ice, causing jams and obstructing the ability of the floating vessel 1 to maneuver within the pond. During operation, the hydraulically pivotal hitch 29 can be alternatively used as a striking tool to help break up sections of ice that may be obstructing and limiting the maneuverability of the vessel. By simply actuating hydraulic cylinder 33 back and forth, the hitch 29 can be manipulated upward and downward with a striking force that can help break up ice and facilitate maneuverability.

As noted previously, another aspect of the present invention includes folding wings or pontoons 5 mounted on opposite sides of the floating agitator vessel 1. These wings 5 are also hydraulically operated, and can be raised and lowered via remote control. Consequently, for travel and storage, the wings 5 can be hydraulically lifted to an upright position, thereby significantly reducing the width of the vessel 1 for ease in road travel and passage through tight areas, such as gates, etc. For launching the vessel 1, the wings 5 are simply lowered for floatation.

As an optional feature, it is also contemplated that the boat may be outfitted with lights for nighttime operation; such lighting may be mounted upon the deck 3 or separately on each of the nozzles 11. With all pressure nozzles 11 for agitation and directional control of the vessel 1 being above-surface and highly visible, nighttime operation of the floating manure agitator with appropriate lighting is readily available, if desired.

Figure 6:
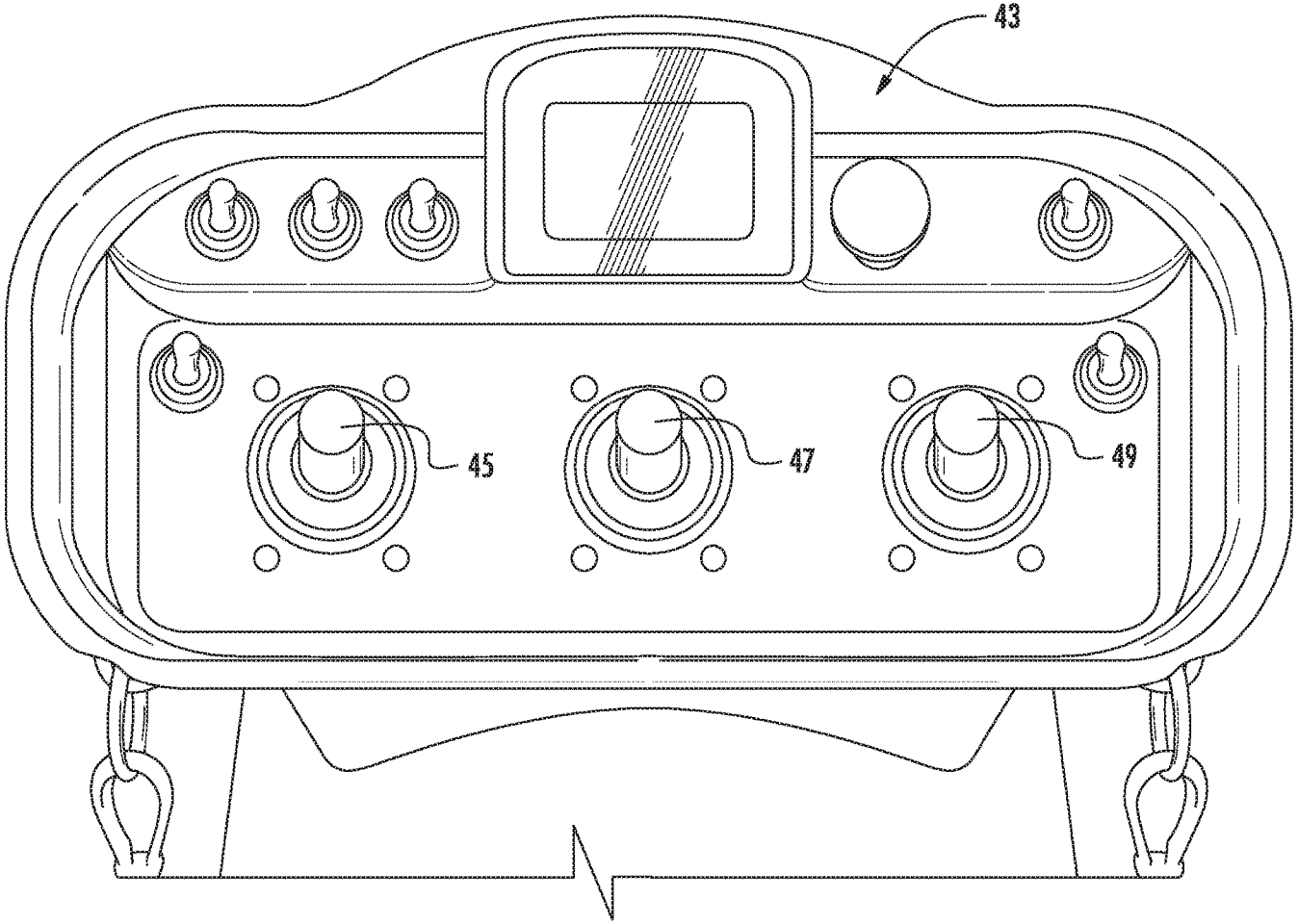
FIG. 6 is a close-up top plan view of the hand-held joy stick controller used to control operation of the floating manure agitator vessel.
Figure 7:
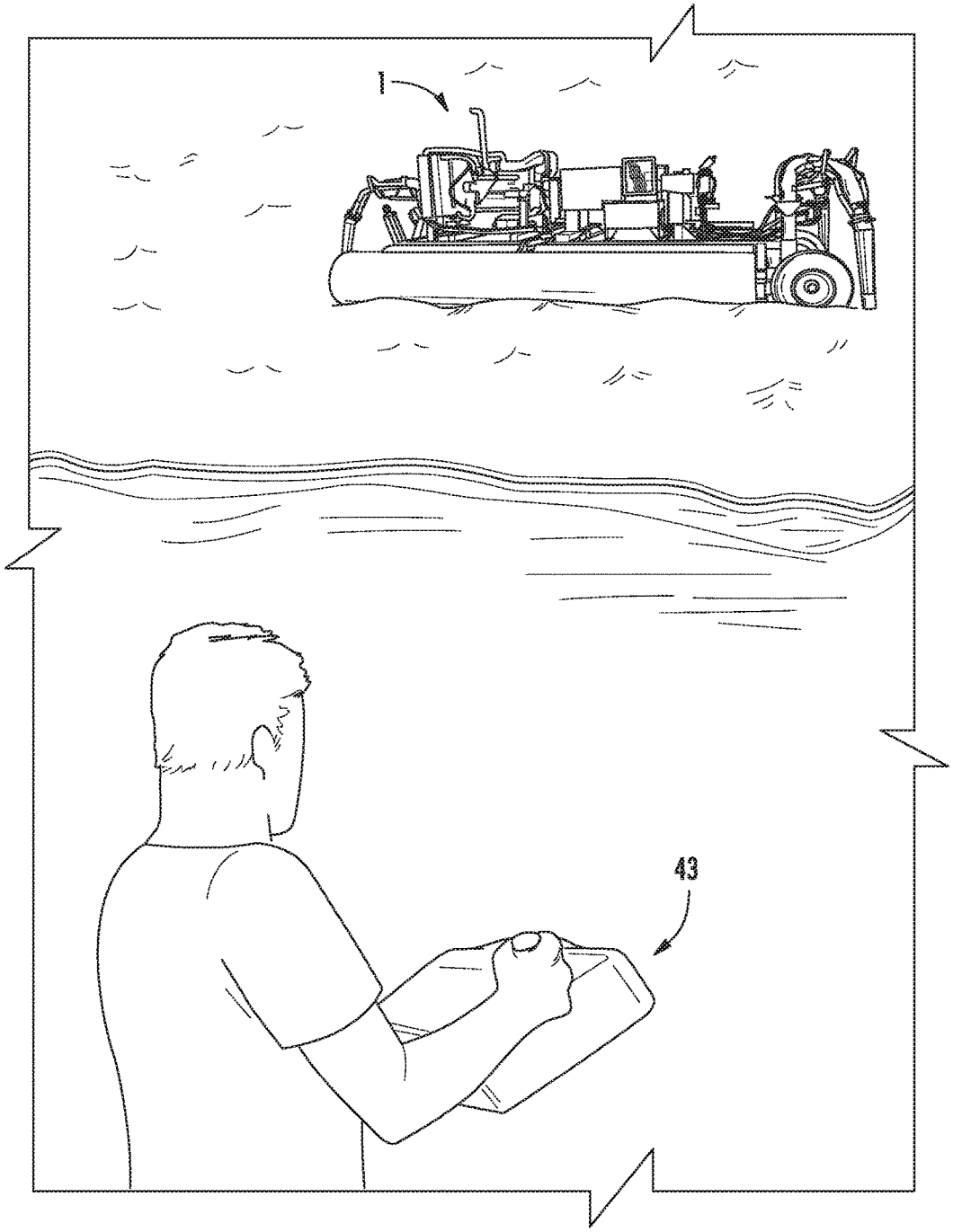
FIG. 7 is diagrammatic view showing the manner in which an operator may control the manure agitator vessel remotely using the hand-held joy stick controller shown in FIG. 6.

With reference now being made to FIGS. 6 and 7, it is noted that, in a preferred embodiment, all hydraulic applications, including operation of the multi-axis pressure nozzles 11, and the hydraulic undercarriage 7, hitch 29 and side wings 5, are remotely controllable through the use of a user-friendly handheld control unit 43. As best shown in FIG. 7, the operator may control all hydraulic applications using the handheld control unit 43 from a location remote of the deck of the manure agitator 1. For ease of operating the multi-axis rotating pressure nozzles 11, the control unit 43 incorporates separate joystick controls (45, 47, 49) for each, such that the operator can easily maneuver each of the nozzles at will with full view of the nozzle's positioning at all times. Consequently, there is no guesswork involved as to where the nozzles 11 are being pointed for agitation and directional control purposes.

Accordingly, it can be seen that the system and methods of the present invention readily achieve the advantages and objectives discussed above as well as those inherent therein. While certain preferred embodiments of the present invention have been described and illustrated herein for the purposes of this disclosure, it will be understood that various changes may be made in the form, details, arrangement and sequence thereof without departing from the scope of the present invention herein, which comprises the matter shown and described herein and set forth in the appended claims.

The invention claimed is:

1. A remotely controllable floating aquatic manure agitator, comprising:

(a) an aquatic vessel being constructed to float upon a reservoir of manure effluent, said vessel having a deck with outer confines defining a bow end and a stern end, a starboard side and a port side, and an upper surface supported above said reservoir;

(b) a plurality of agitator nozzles mounted on the upper surface of said vessel deck, each of said agitator nozzles being configured for pivotal movement about multiple axes relative to said deck, and for rotational movement beyond said outer confines of one of said bow end and said stern end of said deck, and at least one of said starboard side and said port side of said deck;

(c) a hydraulically controlled actuating mechanism connected to each of said agitator nozzles for controlling movement thereof about each of said multiple axes;

(d) a handheld user remote control unit controllably linked to said hydraulically controlled actuating mechanism for each of said agitator nozzles for remotely controlling the operation thereof;

(e) a fluid pump mounted on said deck of said vessel, said pump being configured to extract said manure effluent from said reservoir and pump said manure effluent through said agitator nozzles in order to agitate said manure effluent and manage directional control of said vessel; and (f) each of said agitator nozzles being readily viewable above said upper surface of said deck for ease of managing agitation of said manure effluent and directional control of said vessel.

2. The floating aquatic manure agitator of claim 1, wherein said remote control unit has joystick controls for controlling movement of said agitator nozzles from a location remote of said deck.

3. The floating aquatic manure agitator of claim 1, wherein each of said agitator nozzles is constructed to be pivotal substantially 180 degrees about a vertical axis.

4. The floating aquatic manure agitator of claim 1, wherein each of said agitator nozzles includes a terminal end portion that is constructed to be vertically movable more than 90 degrees relative to a horizontal axis.

5. The floating aquatic manure agitator of claim 1, wherein a pair of said agitator nozzles is mounted one each upon opposing aft corner portions of said deck, and another of said agitator nozzles is mounted upon a bow portion of said deck.

6. The floating aquatic manure agitator of claim 5, wherein said agitator nozzles are operable from a location remote of said deck via the use of a hand-held joystick control module, and each of said agitator nozzles are separately operable with independent joystick controls.

7. The floating aquatic manure agitator of claim 1, wherein said vessel includes a hydraulically operable hitch for connecting to a vehicle to facilitate launching and removal of said vessel from said reservoir of manure effluent.

8. The floating aquatic manure agitator of claim 1, wherein said vessel includes a pair of floatation devices connected one each adjacent opposing sides of said deck to support said deck in floating relation upon said manure effluent, said floatation devices being retractable to an upright position for ease of transporting said vessel out of said reservoir of manure effluent.

9. The floating aquatic manure agitator of claim 1, wherein said deck includes an extendable probe mechanism for probing a bottom area of said reservoir to determine the extent of sludge build-up and need for agitation of said bottom area, said probe being cantilevered from an elongated frame which is pivotally mounted to said deck at a point generally central distance between said bow end and said stern end of said deck, and extending rearward therefrom to a point adjacent said stern end of said deck.

10. The floating aquatic manure agitator of claim 9, wherein said probe is configured to elevate a portion of said vessel relative to an upper surface of said reservoir upon which said vessel floats when sludge build-up is detected at said bottom area of said reservoir being probed.

11. The floating aquatic manure agitator of claim 9, wherein said probe mechanism is comprised of an undercarriage having wheels for assisting in removal of said vessel from said reservoir of manure effluent.

12. A remotely controllable floating aquatic manure agitator, comprising:

(a) an aquatic vessel being constructed to float upon a reservoir of manure effluent, said vessel having a deck with outer confines defining a bow end and a stern end, a starboard side and a port side, and an upper surface supported above said reservoir;

(b) a pair of hydraulically operable agitator nozzles mounted one each on opposing aft corner portions of said upper surface of said deck, and another hydraulically operable agitator nozzle mounted upon a bow portion of said upper surface of said deck;

(c) each of said agitator nozzles mounted on said aft corners of said deck being configured for directional movement beyond said outer confines of said stern end of said deck and one of said starboard side and said port side of said deck, and said agitator nozzle mounted on said bow portion of said deck being configured for directional movement beyond said outer confines of said bow end of said deck and both said starboard side and said port side of said deck, and each of said agitator nozzles being pivotal substantially 180 degrees about a vertical axis and more than 90 degrees about a horizontal axis;

(d) a handheld user remote control unit controllably linked to said hydraulically operable agitator nozzles for remotely controlling the operation thereof;

(d) a fluid pump mounted on said deck of said vessel, said pump being configured to extract said manure effluent from said reservoir and pump said manure effluent through said agitator nozzles in order to agitate said manure effluent and manage directional control of said vessel; and (e) each of said agitator nozzles being readily viewable above said upper surface of said deck for ease of managing agitation of said manure effluent and directional control of said vessel.

13. The floating aquatic manure agitator of claim 12, wherein said remote control unit includes joystick controls for operating said agitator nozzles, and said agitator nozzles that are mounted upon said aft corner portions of said deck are controlled by separate joystick controls than said agitator nozzle mounted upon said bow portion of said deck.

14. The floating aquatic manure agitator of claim 12, wherein said vessel includes a hydraulically operable hitch connected to said bow portion of said deck which is remotely controllable upward and downward for connecting to a transport vehicle to facilitate launching and removal of said vessel from said reservoir of manure effluent without manual manipulation.

15. The floating aquatic manure agitator of claim 12, wherein said vessel includes a pair of floatation devices connected one each adjacent opposing sides of said deck to support said deck in floating relation upon said manure effluent, said floatation devices being retractable to an upright position for ease of transporting said vessel out of said reservoir of manure effluent.

16. The floating aquatic manure agitator of claim 12, wherein said deck includes an extendable probe mechanism for probing a bottom area of said reservoir to determine the extent of sludge build-up and need for agitation of said bottom area, said probe being cantilevered from said deck at a point about central distance between said stern end and said bow end thereof, and extending rearward therefrom to a point adjacent said stern end of said deck.

17. The floating aquatic manure agitator of claim 16, wherein said probe is configured to elevate a portion of said vessel relative to an upper surface of said reservoir upon which said vessel floats when sludge build-up is detected at said bottom area of said reservoir being probed.

18. The floating aquatic manure agitator of claim 16, wherein said probe mechanism is comprised of an undercarriage having wheels for assisting in removal of said vessel from said reservoir of manure effluent.

19. A remotely controllable floating aquatic manure agitator, comprising:

(a) an aquatic vessel being constructed to float upon a reservoir of manure effluent, said vessel having a deck with outer confines defining a bow end and a stern end, a starboard side and a port side, and an upper surface, said deck being supported above said reservoir by a pair of retractable flotation devices;

(b) a plurality of agitator nozzles mounted on the upper surface of said vessel deck, each of said agitator nozzles being configured to pivot around multiple axes relative to said deck, and for rotational movement beyond said outer confines of one of said bow end and said stern end of said deck, and at least one of said starboard side and said port side of said deck;

(c) a retractable undercarriage attached to said aquatic vessel;

(d) a transport hitch pivotally mounted upon said aquatic vessel;

(e) a hydraulically controlled actuating mechanism connected to each of said agitator nozzles, said floatation devices, said undercarriage and said hitch for controlling movement thereof;

(f) a handheld user remote control unit controllably linked to all of said agitator nozzles, said floatation devices, said undercarriage and said hitch for controlling remote operation thereof;

(g) a fluid pump mounted on said deck of said vessel, said pump being configured to extract said manure effluent from said reservoir and pump said manure effluent through said agitator nozzles in order to agitate said manure effluent and manage directional control of said vessel; and (h) each of said agitator nozzles being readily viewable above said upper surface of said deck for ease of managing agitation of said manure effluent and directional control of said vessel.

* * * * *